US011668082B2

(12) United States Patent
Guthrie et al.

(10) Patent No.: US 11,668,082 B2
(45) Date of Patent: Jun. 6, 2023

(54) TOILET FLAPPER REPLACEMENT KIT AND ASSEMBLY

(71) Applicant: Lavelle Industries, Inc., Burlington, WI (US)

(72) Inventors: Kevin J. Guthrie, Wind Lake, WI (US); Michael A. Dean, Genoa City, WI (US)

(73) Assignee: Lavelle Industries, Inc., Burlington, WI (US)

( * ) Notice: Subject to any disclaimer, the term of this patent is extended or adjusted under 35 U.S.C. 154(b) by 0 days.

(21) Appl. No.: 17/393,848

(22) Filed: Aug. 4, 2021

(65) Prior Publication Data

US 2022/0042293 A1 Feb. 10, 2022

Related U.S. Application Data

(60) Provisional application No. 63/060,742, filed on Aug. 4, 2020.

(51) Int. Cl.
*E03D 1/30* (2006.01)
*E03D 1/34* (2006.01)

(52) U.S. Cl.
CPC ..... *E03D 1/306* (2013.01); *E03D 1/34* (2013.01)

(58) Field of Classification Search
CPC ... E03D 1/142–145; E03D 1/306; E03D 1/34; E03D 1/35
USPC ..... 4/225.1, 382
See application file for complete search history.

(56) References Cited

U.S. PATENT DOCUMENTS 3,996,629 A * 12/1976 Riedel ..... E03D 1/142 4/395
5,848,442 A 12/1998 Denzin
6,401,269 B1 * 6/2002 Andersen ..... E03D 1/308 4/386
6,651,264 B2 11/2003 Halloran et al.
6,742,194 B2 * 6/2004 Shim ..... E03D 1/306 4/386
7,937,782 B2 * 5/2011 Vosler ..... E03D 1/306 4/395
8,104,103 B2 * 1/2012 Han ..... E03D 1/306 4/392
8,690,123 B2 4/2014 Fu
9,791,049 B2 * 10/2017 Guthrie ..... E03D 1/306

* cited by examiner

*Primary Examiner* — David P Angwin
*Assistant Examiner* — Nicholas A Ros
(74) *Attorney, Agent, or Firm* — Amundsen Davis, LLC; Joseph S. Heino; Erin E. Kaprelian

(57) ABSTRACT

A flapper kit comprises a flapper body, a pair of mounting legs disposed rearwardly of the flapper body and a unitary mounting bar, the mounting bar used in combination with a flush valve overfill portion, the collective elements forming an assembly.

14 Claims, 6 Drawing Sheets

TOILET FLAPPER REPLACEMENT KIT AND ASSEMBLY

This Application claims the benefit of U.S. Provisional Application No. 63/060,742, filed Aug. 4, 2020.

FIELD OF THE INVENTION

The present invention relates generally to indoor plumbing and gravity-operated flush toilets. More particularly, however, the present invention relates to flapper valves (or "flappers") that are used in such toilets. The improved flapper provides for and can be used in a variety of flapper "constructs" that replace a plurality of other flappers that are commercially available. The flapper constructs can be provided in the form of a single "kit" for end users.

BACKGROUND OF THE INVENTION

Conventional gravity-operated flush toilets have several basic components. The porcelain or china components include a bowl and a water tank mounted on top of a rear portion of the bowl. The bowl and tank can be separate pieces bolted together to form a two-piece toilet or can be made as a one-piece toilet in which the bowl and tank are one continuous integral piece of china.

More importantly, however, the plumbing components of the gravity-operated flush toilet include a fill valve in the tank which is connected to a water supply line, a flush valve surrounding a main flush valve orifice or drain hole in the bottom of the tank that communicates with the bowl, and a flapper that normally closes and seals the flush valve or, more precisely, the main flush valve orifice of the flush valve.

Toilet flappers are typically formed as a single structure having a rim for sealing the main flush valve orifice with the flapper rim following flushing. The flapper is often formed of a soft elastomeric material and is hinged to allow it to be pivotally moved upwardly and away from the main flush valve orifice by means of a chain that is connected to a flush handle on the outside of the tank. Once the tank empties, the flapper then returns to a position where it seals the main flush valve orifice, the rim of soft elastomeric material forming a seal about that main flush valve orifice, such as rubber. Other flappers are configured of an elastomeric ring but include more rigid plastic structure for supporting the peripheral rim.

The flapper mentioned above is typically secured to the flush valve by virtue of a pair of spaced apart parallel mounting arms. The mounting arms typically include apertures, the apertures being used to rotatably connect the flapper to "pegs" that form part of the flush valve and extend outwardly from the sides of a tubular overflow member. The tubular overflow member can be cylindrical or rectangular in cross section but is not so limited. Depending on the make and model of toilet tank, the size of its flush valve determines how far apart the mounting arms must be in order to accommodate a specific size of flapper for that flush valve. In other configurations, and particularly where the overflow member is rectangular, it is possible that the mounting arms of the flapper engage a cylindrical bar that is mounted transversely within a pair of C-shaped "channels" disposed to the rear of the flush valve—or opposite the main flush valve orifice. A plurality of such channels may be provided to allow for differently-sized flappers.

Located forwardly of the flapper valve mounting arms is a ballast structure that controls the buoyancy of the flapper.

The buoyancy of a flapper is an important function because it determines how much or how little water is used to empty the water tank upon flushing, thus creating water conservancy issues.

In the experience of this inventor, there is a need to provide an improved flapper mounting structure that allows for variability of sizes of flush valves and flappers and that allows the flapper to attach via the side-mounted pegs or the plurality of rear-mounted plurality of C-shaped channels that are disposed within or attached to overflow tubes of current manufacture. All of these elements are preferably provided as part of an aftermarket "kit", but the structures identified herein are not limited to being part of a kit.

SUMMARY OF THE INVENTION

As a preliminary matter, the structure of the present invention is one with which the type of flapper disclosed in U.S. Pat. No. 9,791,049 to Guthrie et al., titled "TOILET FLAPPER VALVE WITH ADJUSTABLE MOUNTS AND ASSEMBLY" (the '049 patent), could be used. In particular, those portions relating to the mounting legs and associated structure are incorporated herein by reference. However, the structures identified in this disclosure are not so limited because the structure presented herein includes additional structural features that enhance performance of the flapper.

The present invention provides a "kit" that allows rotatable attachment of the flapper to two different types of flush valve structures, as alluded to above—one having side-mounting pegs and one having a plurality of rear-mounted C-shaped receiving channels. As disclosed herein, the flapper of the type mentioned above can be used in alternatively sized flush valves, depending on the type or size of the flush valve outlet opening or main flush valve orifice. The foregoing and other features of the improved flapper attachment means will be apparent from the detailed description that follows.

DETAILED DESCRIPTION

Figure 15:
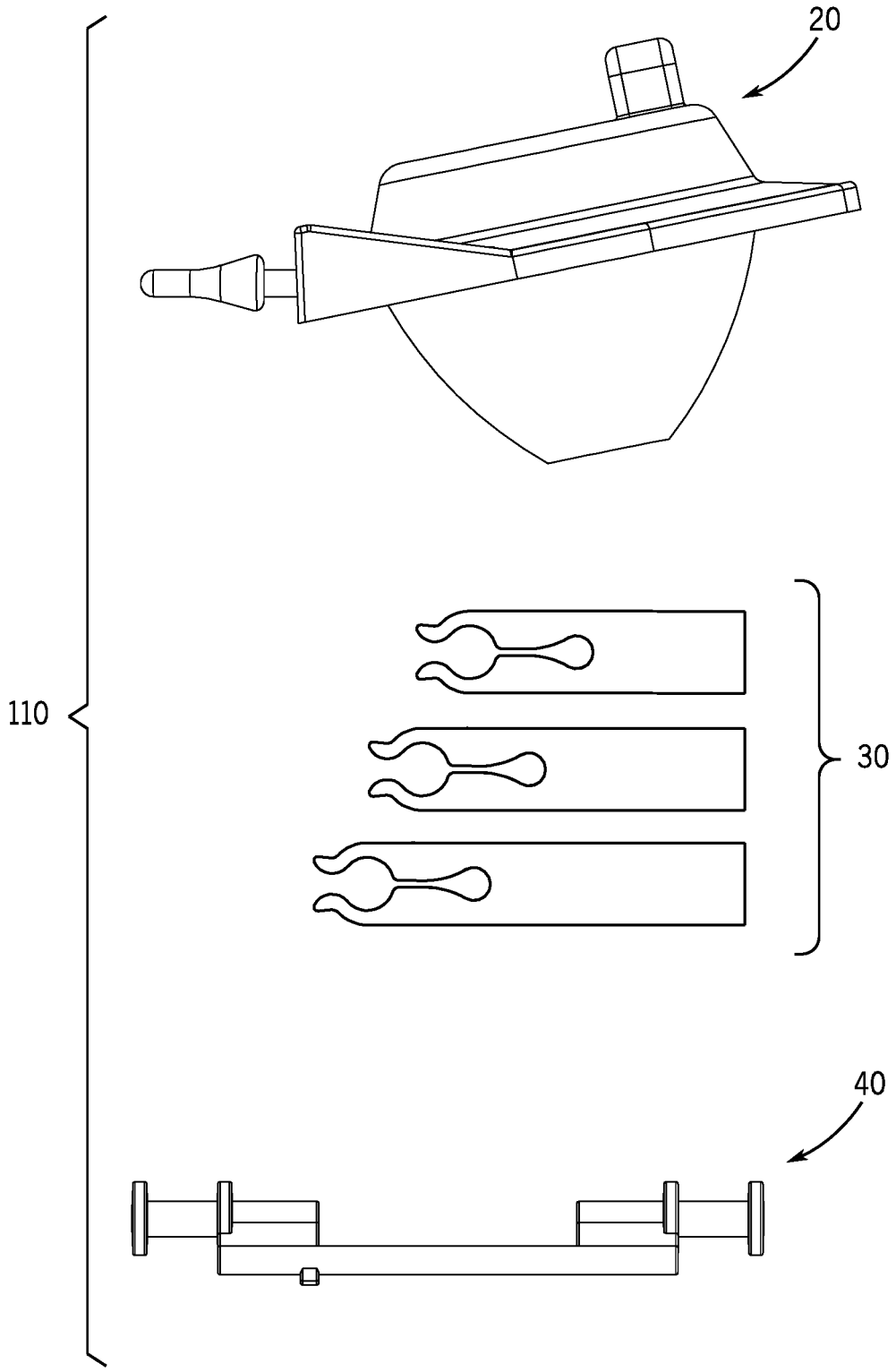
FIG. 15 is a side view of the unassembled elements of a representative "kit" in accordance with the present invention.

As a preliminary matter and general overview, it is to be understood that the improved assembly replaces at least four flapper constructs that are currently available in the market. This assembly is presented to the user as a "kit", generally identified 110 See FIG. 15. The kit 110 has one rubber flapper with an integral ball but is not limited to having a plastic retained ball for buoyancy. The kit 110 has three sets of legs, at least one of which can be paired with the rubber flapper for a specific flush valve. A leg joint is so designed to allow a rubber interference fit between the leg and the flapper. This joint is flexible thereby allowing the flapper to seal at irregular angles. The kit 110 further comprises a bar that can be snapped into a multitude of "locations" (previously identified as the "C-shaped receiving channels") to adjust to the best flush valve seal surface height. Moreover, the bar is configured as a cylindrical bar feature that is attachable to one of the C-shaped receiving channels and includes a locking lobe which prevents the bar from rotating out of position.

As to a second use for the kit 110, wherein the legs are attachable to the outwardly-extending "pegs" of the flush valve, a clip portion provide a "pincer" action such that the mounting legs can "capture" the pegs that form part of the flush valve within an opening in each leg to rotatably connect the flapper to the flush valve. This allows the mounting legs to rotate the flapper when the flush valve is actuated. It should also be appreciated that the size of the mounting legs can be altered to accommodate flush valve pegs of different diameters. That is, a mounting leg having a wider or narrower opening is intended to be included within the scope of this invention.

Figure 3:
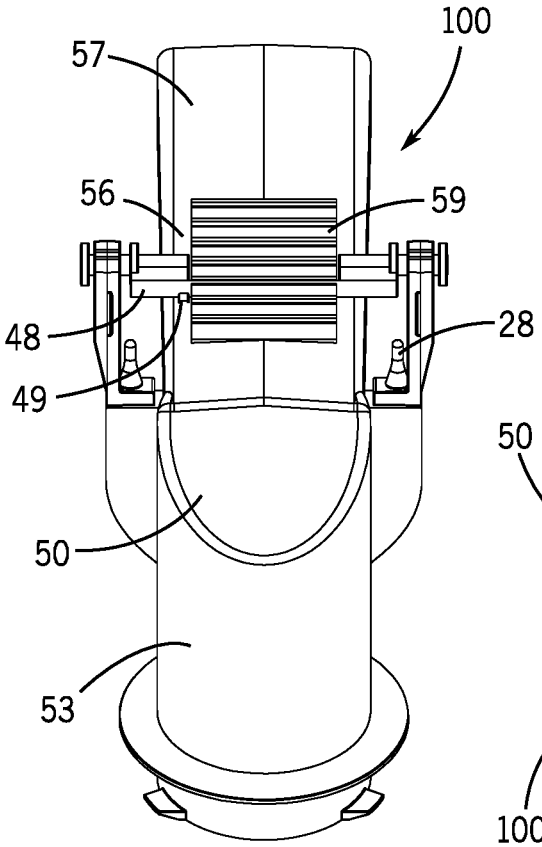
FIG. 3 is a bottom and rear view of the flush valve with flapper, this view being a projection from FIG. 1.
Figure 4:
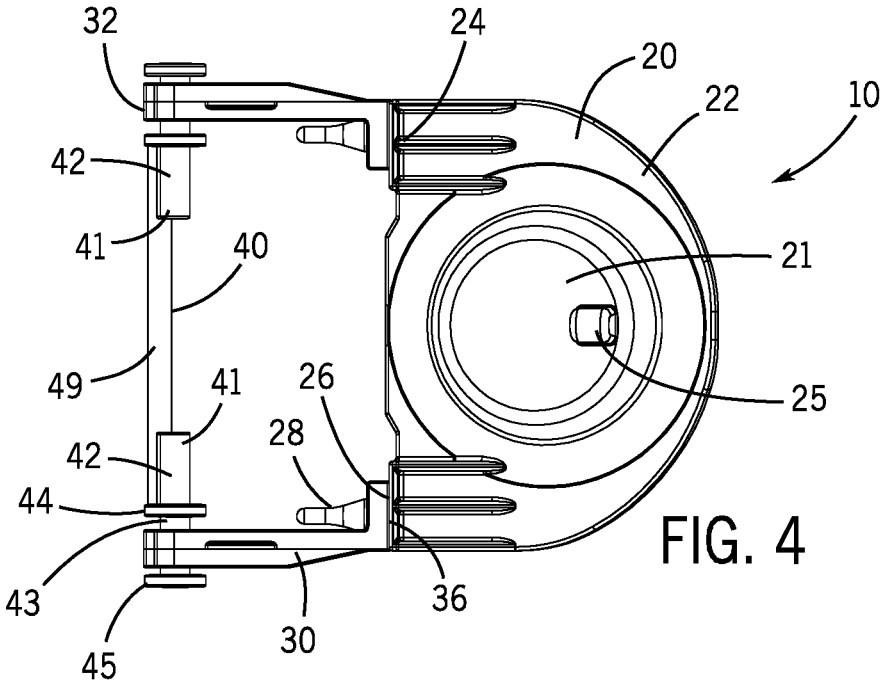
FIG. 4 is a top plan view of the flapper shown in FIG. 1, less the flush valve.

Referring now to the drawings in detail, wherein like-numbered elements refer to like elements throughout, FIG. 4 illustrates one way that the preferred embodiment can be configured. Specifically, FIG. 4 shows the flapper, generally identified 10, that comprises four primary elements: a flapper body 20; a pair of mounting legs 30 disposed rearwardly of the flapper body 20; and a mounting bar structure 40. When used in combination with the flush valve 50, the collective elements form the assembly 100. See FIGS. 1-3.

The flapper body 20 is typically made of an elastomeric material such as real or synthetic rubber having a suitable durometer or softness. In the preferred embodiment, the flapper body 20 is comprised of a real rubber material for suitable sealing with chemical resistance by virtue of CHLORAZONE® additive (CHLORAZONE is a registered trademark of Lavelle Industries, Inc. The flapper body 20 has a top surface 21, a bottom surface 23 and a circumferential peripheral lip 22.

Figure 7:
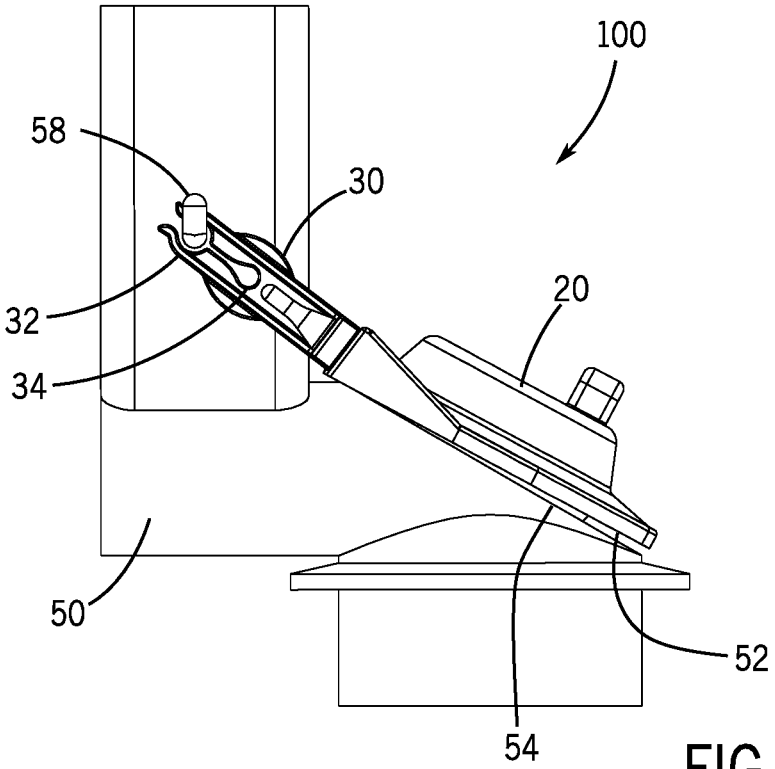
FIG. 7 is a left elevation view of another portion of the kit where the improved flush valve with flapper is constructed in accordance with the present invention.
Figure 10:
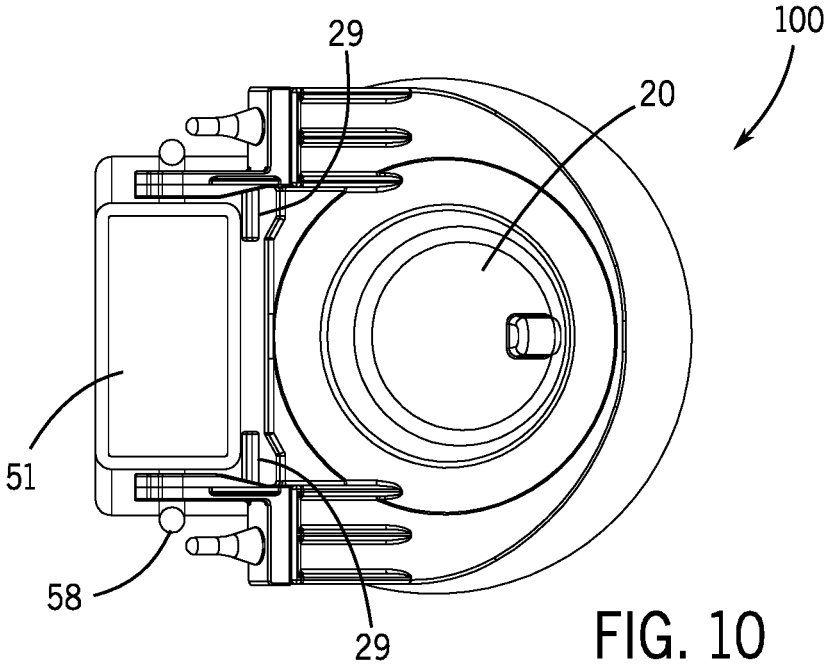
FIG. 10 is a top plan view of the structure shown in FIG. 9.
Figure 9:
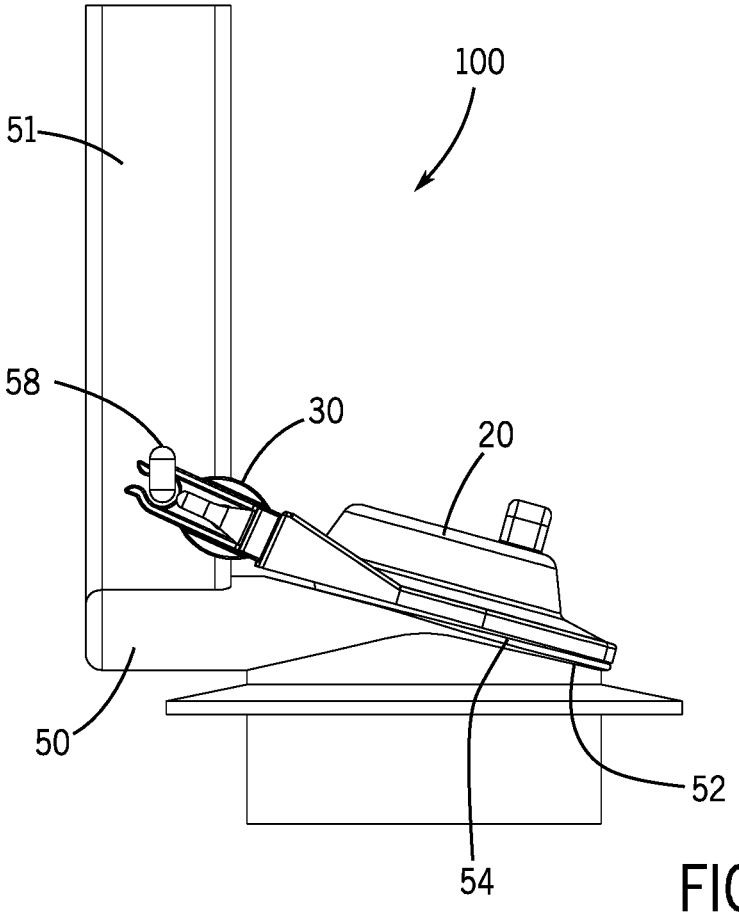
FIG. 9 is a left elevation view of another way the kit can be utilized.

Forwardly of the top surface 21 of the flapper body 20 and extending upwardly from that top surface 21 is a connection structure 25. The connection structure typically includes an aperture (not shown) to receive a hook and chain-like structure (also not shown) for lifting the flapper valve 10 upwardly during the initiation of the flush cycle of the toilet. The peripheral lip 22 is configured to mate with the valve seat 52 of the main flush valve orifice 54 to close off water flow through that orifice 54. See FIGS. 7 and 9.

Extending rearwardly of the flapper body 20 and also disposed on the top surface 21 thereof is a pair of spaced-apart parallel leg clip mounting structures 24. Each mounting structure 24 comprises a rearward flat 26 and a retainer 28 extending rearwardly from the flat 26. Again, see FIG. 3. The retainer 28 comprises a peripheral groove (not shown) that is disposed immediately adjacent the rearward-facing surface of the rearward flat 26. The mounting structures 24 and all of their respective component structures can be integrally formed as part of the flapper body 20, but typically are not.

Figure 11:
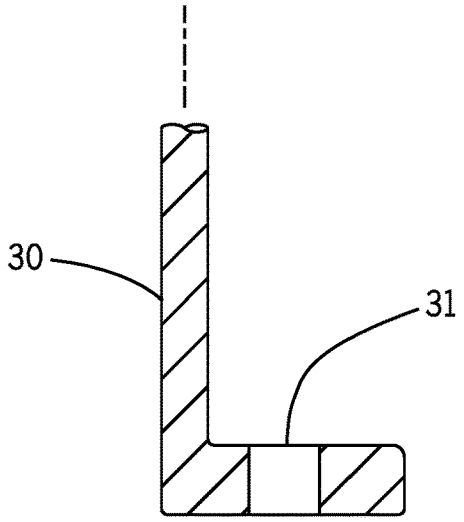
FIG. 11 is an enlarged cross-sectioned partial view of the mounting leg shown in FIGS. 7-10 and illustrating the hole defined in the leg.
Figure 12:
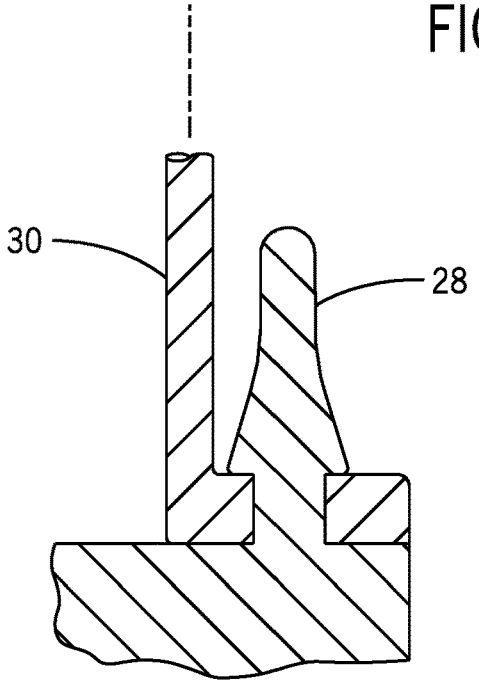
FIG. 12 is a further enlarged cross-sectioned partial view of a mounting leg secured to a retainer where the mounting leg is disposed in a "narrow setting" position.
Figure 13:
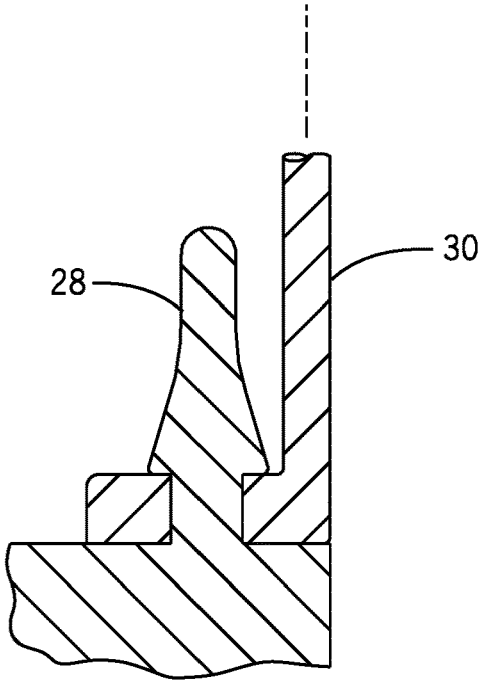
FIG. 13 is a view similar to FIG. 12 but showing the mounting leg disposed in a "wide setting" position.
Figure 14:
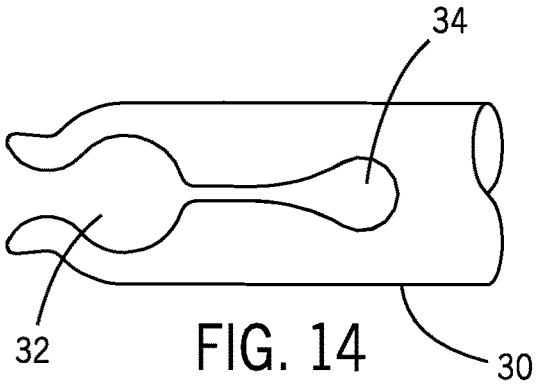
FIG. 14 is a view of the end of the clip portion of a mounting leg.

That is, attachable to each flat 26 of the leg clip mounting structures 24 are opposing mounting legs 30. Each mounting leg 30 is a substantially L-shaped structure having a forward facing flat 36, which flat 36 has a hole 31 defined in it. The hole 31 is configured to receive the retainer 28 of the flapper body 20. The retainer 28, like the remainder of the flapper body 20, is made of rubber which allows the retainer 28 to be resiliently compressed when pulled on to pass through the hole 31 in the flat 36 of the leg 30. Once captured, the mounting leg 30 is rotatable about the axis of the retainer 28 such that the mounting legs 30 can be rotated inwardly to set them in a "narrow setting" position, as is shown in FIGS. 7-12. The mounting legs 30 could also be rotated outwardly and set in a "wide setting" position see FIGS. 4 and 13. Extending rearwardly from the flat 36 is a clip portion 32, the clip portion 32 having an opening 34. The clip portion opening 34 provides a "pincer" action such that the mounting legs 30 can "capture" the pegs 58 that form part of the flush valve 50 to rotatably connect the flapper valve 10 to the flush valve 50. This allows the mounting legs 30 to rotate the flapper valve 10 when the flush valve 50 is actuated. It should also be appreciated that the size and length of the mounting legs 30, and the size and length of the opening 34, are provided so that the kit 110 can accommodate flush valve pegs 58 of different diameters and different positions depending on the flush valve 50 with which the legs 30 of the kit 110 are used. Lastly, it will be appreciated that the flapper body 20 comprises a "stop" member 29, as shown in FIG. 11, to limit the upward travel of the flapper body 20.

Figure 2:
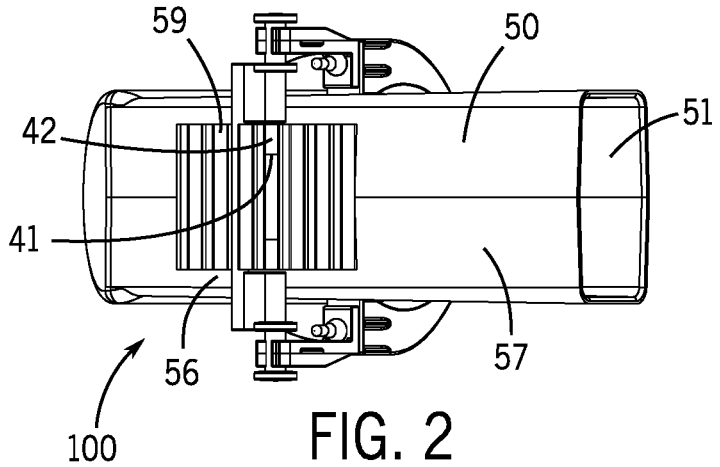
FIG. 2 is a top and rear view of the flush valve with flapper, this view being a projection from FIG. 1.
Figure 1:
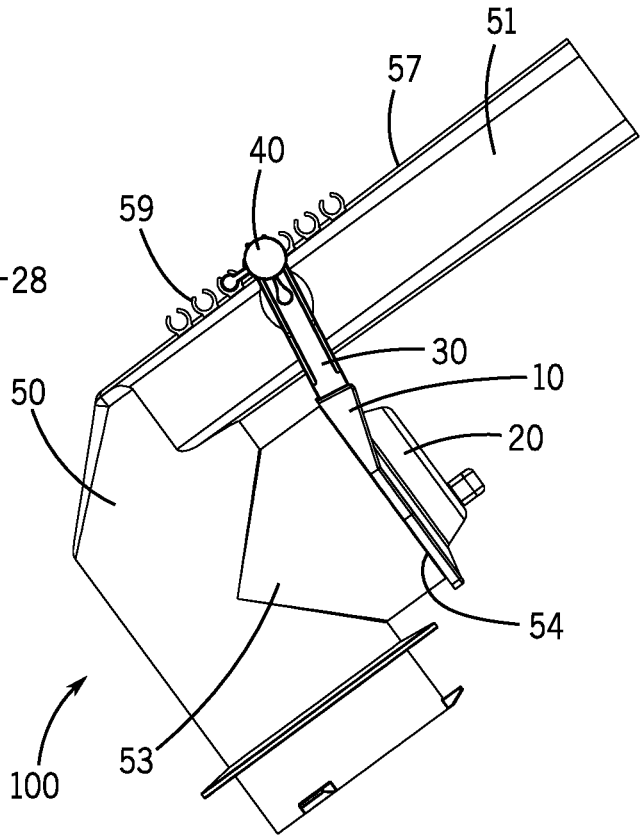
FIG. 1 is a left side elevation view of a flapper and a bar structure that is constructed in accordance with the present invention, which flapper and bar structure comprising parts of a flapper "kit"—the view showing the flush valve tipped forwardly about 45°.

Referring now to FIGS. 1-3, they show a flush valve, generally identified 50, which is about 45° out of vertical. That is, rotation of the flush valve 50 (as shown in FIG. 1) counterclockwise, by about 45°, places the flush valve 50 in its normal upright and fully installed position. The flush valve 50 comprises an overflow tube 51 and an outlet 53 having a sealing surface 54. This sealing surface 54 is the surface that the peripheral lip 22 of the flapper 20 seats during its non-flush position. To the rear 57 of the overflow tube 51, a number of transversely-extending C-shaped receiving channels 59 are disposed. FIGS. 2 and 3 are projections of FIG. 1, which show the channels 59, the number of which is not limited to the number illustrated herein.

Figure 5:
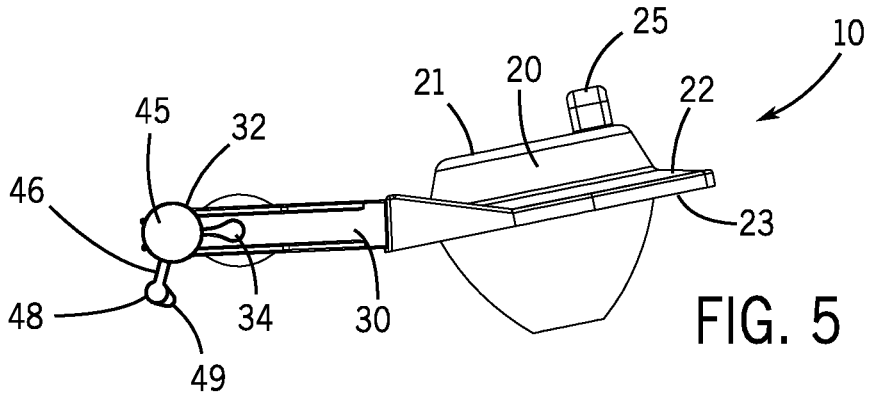
FIG. 5 is a side elevation view of the flapper shown in FIG. 4.
Figure 6:
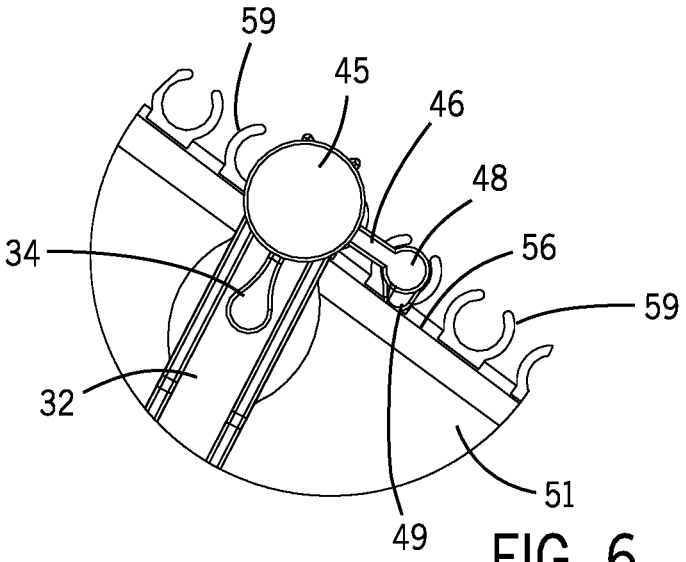
FIG. 6 is an enlarged side view of the bar structure and locking lobe used in conjunction with the C-shaped receiving channels that are shown in FIG. 1.
Figure 8:
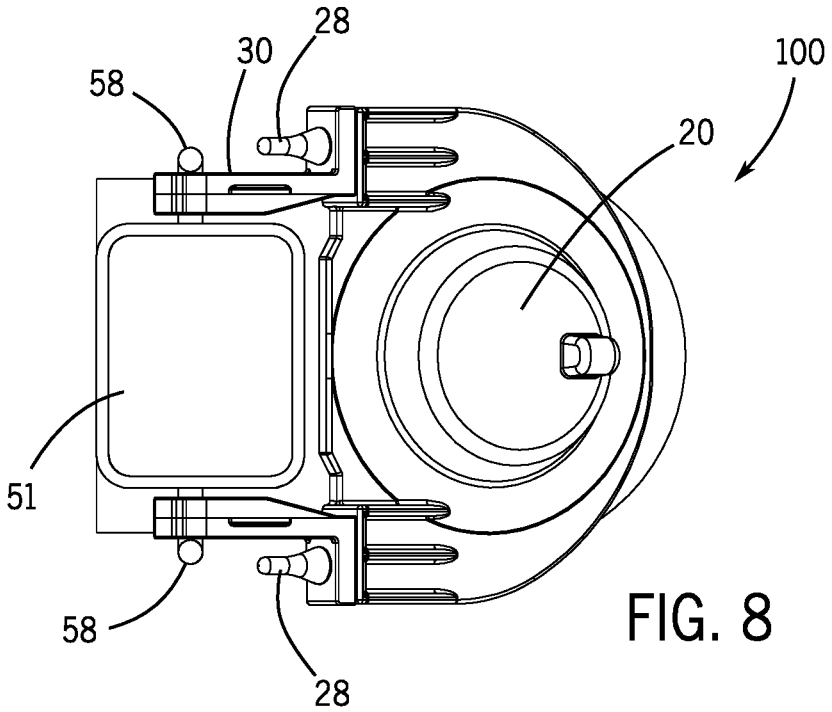
FIG. 8 is a top plan view of the structure shown in FIG. 7.

Now referring back to FIGS. 4-6, it will be seen that the mounting bar structure 40 is preferably a unitary structure that can be "snapped" into place within any pair of axially-aligned C-shaped receiving channels 59 disposed behind the overflow tube 51. A "flat" 56 is disposed to either side of the C-shaped receiving channels 59. The receiving channels 59 used in this fashion need not be adjacent one another. The mounting bar structure 40 comprises two axially-aligned and cylindrical catch structures 42, the innermost portion 41 of which can be received within an end portion of a first channel 59 of the flush valve 50. An outermost portion 43 of the cylindrical catch structure 42 is that portion of the bar that can engage with the opening 34 of the clip portion 32 of the mounting legs 30. To maintain the mounting legs 30 in position when rotatably clipped to the bar 40 structure, an inner flange 44 and an outer flange 45 are provided. To maintain position of the innermost portion 41 of the bar structure 40, a pair of bar-supporting legs 46 extend from the clamping structures 42 and terminate at each end of a bar 48. The bar 48 is configured as a cylindrical structure that is received by a second C-shaped receiving channel 59 and the bar 48 is rotatable within the C-shaped channel 59 that receives and captures it. At least one end of the bar 48 further comprises a locking lobe 49 which, together, maintain the position of the overall mounting bar structure 40 by preventing rotation of it when the mounting legs 30 rotate about the outermost portion 43 of the clamping structure 42. This is accomplished when the lobes 49 contact the flat surface 56 behind the flush valve overflow tube 51 and to either side of the set of C-shaped receiving channels 59. That is, once the lobes 49 contact the flat surface 56, no further rotation of the bar 48 can be made. In this fashion, the legs 30 can rotate as intended without the bar structure 40 rotating with it during a flush cycle. It is also to be understood that the bar 48 could be fabricated using only one lobe 49 on one side of the bar 48. See FIG. 3.

What is claimed is:

1. A toilet flapper kit for rotatably attaching a toilet flapper to a flush valve structure, the structure having a plurality of rear-mounted C-shaped receiving channels disposed within the rear surface of the overflow tube of the flush valve structure, the kit comprising:

a toilet flapper comprising a flapper body having a circular forward portion and a pair of leg clip mounting structures disposed rearwardly of the circular forward portion, the leg clip mounting structures further comprising a rearward flat and a frustroconical retainer;

a pair of mounting legs, each a mounting leg comprising a forward facing flat having an aperture, the aperture being sized to receive and capture the frustoconical retainer to secure the mounting to the rearward flat of the flapper body, and a rearwardly-extending clip portion, wherein the mounting legs are rotatable about the frustoconical retainer from a first position in which the clip portions of the mounting legs are disposed closer to one another to a second position wherein the clip portions are disposed farther apart; and a mounting bar structure comprising two axially-aligned and cylindrical clamping structures that are received at each end of a first C-shaped receiving channel defined in a rearward facing portion of an overflow tube of a flush valve and further comprising a cylindrical bar structure that is received by a second C-shaped receiving channel of the overflow tube of the flush valve structure; each of the cylindrical clamping structures being attached to an end of the mounting bar structure via a bar supporting leg and each of the cylindrical clamping structures further being received within a clip portion opening of the mounting legs at a point;

wherein the clip portions of the mounting legs are rotatable about the cylindrical clamping structures such that the flapper is rotatably connected to the flush valve.

2. The toilet flapper kit of claim 1 further comprising an inner flange and an outer flange disposed to each side of the point where the leg clips are attached to the cylindrical clamping structures of the mounting bar structure.

3. The toilet flapper assembly of claim 1 wherein a single locking lobe is disposed to one end of the bar structure.

4. The toilet flapper kit of claim 1 further comprising a plurality of differently-sized leg clips for allowing use of the kit with a number of differently-sized flush valve structures.

5. The toilet flapper kit of claim 1 wherein the mounting bar structure is formed as a unitary structure.

6. The toilet flapper kit of claim 1 further comprising a locking lobe at each end of the mounting bar structure.

7. The toilet flapper kit of claim 6 further comprising a flat portion to either side of the plurality of rear-mounted C-shaped receiving channels disposed within the rear surface of the overflow tube of the flush valve structure, the locking lobes engaging the flat portion.

8. A toilet flapper assembly comprising:

a flush valve structure comprising an overflow tube and a plurality of C-shaped receiving channels disposed within a rear surface of the overflow tube;

a toilet flapper comprising a flapper body having a circular forward portion and a pair of leg clip mounting structures disposed rearwardly of the circular forward portion, the leg clip mounting structures further comprising a rearward flat and a frustoconical retainer;

a pair of mounting legs each comprising a forward facing flat having an aperture, the aperture being sized sufficiently to receive and capture the frustoconical retainer to secure the mounting to the rearward flat of the flapper body and a rearwardly-extending clip portion, wherein the mounting legs are rotatable about the frustoconical retainer from a first position in which the clip portions of the mounting legs are disposed closer to one another to a second position wherein the clip portions are disposed farther apart; and a mounting bar structure comprising two axially-aligned and cylindrical clamping structures that are received at each end of a first C-shaped receiving channel defined in a rearward facing portion of an overflow tube of a flush valve and further comprising a cylindrical bar structure that is received by a second C-shaped receiving channel of the overflow tube of the flush valve structure; each of the cylindrical clamping structures being attached to an end of the mounting bar structure via a bar supporting leg and each of the cylindrical clamping structures further being received within a clip portion opening of the mounting legs at a point;

wherein the clip portions of the mounting legs are rotatable about the cylindrical clamping structures such that the flapper is rotatably connected to the flush valve.

9. The toilet flapper assembly of claim 8 further comprising an inner flange and an outer flange disposed to each side of the point where the leg clips are attached to the cylindrical clamping structures of the mounting bar structure.

10. The toilet flapper assembly of claim 8 wherein a single locking lobe is disposed to one end of the mounting bar structure.

11. The toilet flapper assembly of claim 8 further comprising a plurality of differently-sized leg clips for allowing use of the kit with a number of differently-sized flush valve structures.

12. The toilet flapper assembly of claim 8 wherein the bar structure is formed as a unitary structure.

13. The toilet flapper assembly of claim 8 further comprising a locking lobe at each end of the mounting bar structure.

14. The toilet flapper assembly of claim 13 further comprising a flat portion to either side of the plurality of rear-mounted C-shaped receiving channels disposed at the rear surface of the overflow tube of the flush valve structure, the locking lobes engaging the flat portion.

* * * * *